United States Patent [19]

Pelavin

[11] 4,433,760

[45] Feb. 28, 1984

[54] DEFORMABLE LIGHTWEIGHT LUGGAGE

[75] Inventor: Joseph Y. Pelavin, North Bergen, N.J.

[73] Assignee: CPG Products Corp., Minneapolis, Minn.

[21] Appl. No.: 352,482

[22] Filed: Feb. 25, 1982

[51] Int. Cl.[3] ..... A45G 13/04

[52] U.S. Cl. ..... 190/115; 190/125; 190/126; 190/127

[58] Field of Search ..... 190/24, 25, 41 R, 41.2, 190/49, 50

[56] References Cited

U.S. PATENT DOCUMENTS

| | | | |
|---|---|---|---|
| Re. 4,060 | 7/1870 | Fischbek | 190/49 |
| 2,718,943 | 9/1955 | Braverman | 190/49 |
| 3,291,267 | 12/1966 | Pelavin | 190/49 |
| 3,447,648 | 6/1969 | Schwennicke | 190/49 |
| 3,504,772 | 4/1970 | Barry | 190/49 X |
| 3,559,778 | 2/1971 | D'Elia | 190/49 |
| 3,592,314 | 7/1971 | Jacobson | 190/49 |
| 3,933,229 | 1/1976 | Pelavin | 190/49 X |
| 3,977,501 | 8/1976 | Alonso | 190/49 |

FOREIGN PATENT DOCUMENTS

| | | | |
|---|---|---|---|
| 1632530 | 1/1970 | Fed. Rep. of Germany | 190/49 |
| 2006255 | 8/1971 | Fed. Rep. of Germany | 190/49 |
| 287423 | 4/1953 | Switzerland | 190/49 |

*Primary Examiner*—William Price
*Assistant Examiner*—Sue A. Weaver
*Attorney, Agent, or Firm*—Gene O. Enockson; L. MeRoy Lillehaugen

[57] ABSTRACT

A resilient U-shaped steel band has its upper ends adjustably attached by means of slotted angle irons to a rigid saddle composed of a panel of fiberboard and a strip of plywood secured thereto. A bottom plate overlies the horizontal section of the band. Fabric sheet material constitutes the outer cover for the luggage being stitched to the fiberboard. A relatively heavy fabric belt is stitched to the cover along the edges of the band, thereby providing a sheath for the band and preventing transverse shifting thereto.

22 Claims, 7 Drawing Figures

DEFORMABLE LIGHTWEIGHT LUGGAGE

BACKGROUND OF THE INVENTION

1. Field of the Invention

This invention relates generally to lightweight luggage, and pertains more particularly to luggage that will readily deform when subjected to various external forces or loads.

2. DESCRIPTION OF THE PRIOR ART

A problem has existed with respect to providing competitively priced luggage that will be both lightweight and sufficiently resilient so that its return to its original shape can be assured, even though severe distorting forces are at times experienced, such as, when the luggage is being mass handled with other baggage, heavy boxes, footlockers, ski equipment and the like.

In the past, reinforcing the frames of soft sided luggage, while desirable, has increased the weight. On the other hand, making the luggage optimally light in weight has detracted from its sturdiness. Even the ability to pick up the luggage, especially when containing relatively heavy items, by its handle without the internal frame bowing or flexing upwardly has been a drawback in the past. The ability to withstand even normal wear is another factor that has, at times, been previously overlooked or ignored. As mentioned above, luggage must be competitively priced, so this has also been a shortcoming with prior art luggage constructions. Consequently, luggage of the general type with which my invention is concerned has been a continual sacrificing or lessening of one capability in order to achieve or improve another.

SUMMARY OF THE INVENTION

Accordingly, a general object of the present invention is to provide luggage that is both readily deformable and light in weight. In this regard, an aim of the invention is to enable the luggage to withstand various compressive and torsional forces, yet instantly spring back to its original configuration when such forces no longer are applied.

Another object of the invention is to provide deformable luggage that can be manufactured at a relatively low cost, thereby encouraging its widespread use.

Yet another object is to provide lightweight luggage that will resist wear and tear. More specifically, it is within the purview of my invention to provide an internal frame that is comprised of parts that will not poke through the outer pliant covering when subjected to deformation-causing forces.

Another object of the invention is to provide luggage that will generally deform to whatever degree is necessary, but which luggage is locally reinforced so that it can be picked up by its handle without upward flexing of the internally disposed frame. In this regard, it is within the contemplation of the invention to have the carrying handle anchored to a relatively rigid saddle extending across the upper portion of the frame.

Still another object of the invention is to provide a relatively rigid saddle as mentioned above, and provide means for connecting the ends of the saddle to upstanding leg portions or sections belonging to a spring band or strip so that the resilient leg portins or sections are in tension when the luggage is being carried. An aim of the invention is to dimension the saddle. It is also within the contemplation of the invention to employ a bottom plate and have the horizontal portion of the U-shaped resilient band underlie the bottom plate, thereby reinforcing the bottom plate to the extent that it can be made quite thin.

Also, an object associated with the two preceding objects is to provide a saddle and bottom plate, particularly the former, which help to impart the desired shape to the luggage.

The invention also has still another object the combining of various materials so as to effectively achieve the overall deformability and reduced weight that is desired, but which will enable portions of the flexible cover to be stitched to internal parts in a way such that the bag's sturdiness is enhanced.

Yet another object is to minimize the need for close tolerances as far as the various components forming my luggage are concerned.

Briefly, my invention envisages the provision of a frame comprising a relatively rigid saddle composed of fiberboard and plywood which helps to give shape to the upper portion of the luggage. The ends of the saddle are connected to relatively thin upstanding leg sections integral with a U-shaped resilient steel band, the attachment being by means of rigid, slotted angle irons. The slots in both legs of the angle iron permit individual adjustments to be effected during the fabrication of the luggage, so that close manufacturing tolerances are not necessary. The horizontal portion of the resilient steel band underlies a relatively thin aluminum bottom plate, the underlying portion of the band reinforcing the bottom plate. The frame is covered with various layers of flexible sheet material, preferably of appropriate fabric. Appropriately located stitching is provided which contributes to the overall sturdiness and lightness of the luggage.

BRIEF DESCRIPTION OF THE DRAWINGS

FIG. 6 is an enlarged transverse sectional view taken in the direction of line 6—6 of FIG. 1, but with an intermediate vertical portion removed in order to permit a larger scale to be employed.

DESCRIPTION OF THE PREFERRED EMBODIMENT

Figure 1:
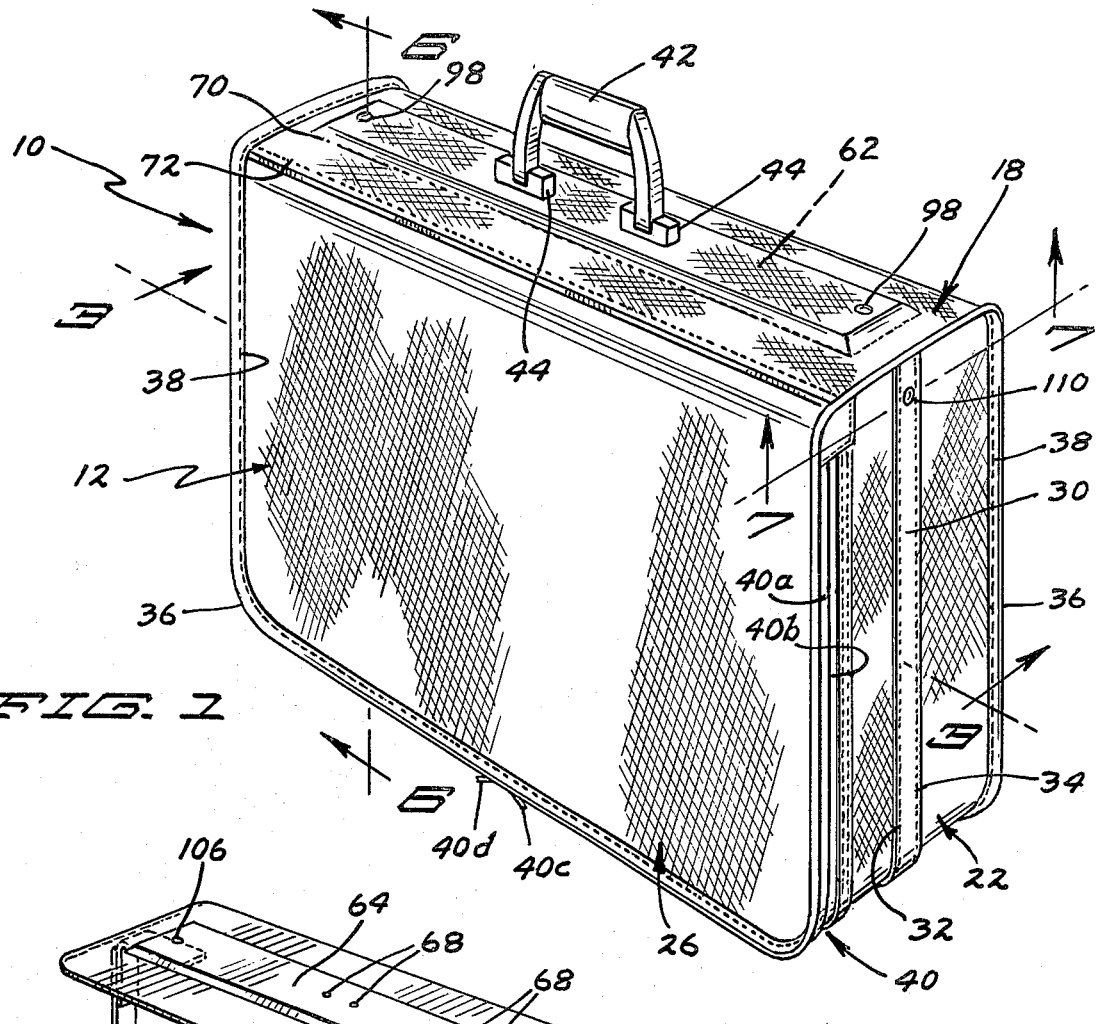
FIG. 1 is a perspective view of luggage exemplifying my invention.

Luggage in the form of a suitcase constructed in accordance with my invention has been denoted generally by the reference numeral 10 in FIG. 1. The luggage 10 includes an outer flexible covering 12, preferably of fabric, although it can be of other materials, such as vinyl or leather. The luggage 10 includes an inner liner 14 of fabric. Although not important to my invention, an intermediate fabric layer 16 of Pellon is employed, the layer 16 being illustrated only to show a suitace corresponding to what is currently being marketed by applicant's assignee.

The luggage 10 further comprises what will be termed a top wall 18, a bottom wall 20, end walls 22, 24, a front wall 26 and a rear wall 28. Centrally disposed along each of the end walls 22, 24 is a strip 30 of heavy belt-like fabric, the belt 30 continuing beneath the bottom wall 20. Two rows of stitching 32, 34 secure the flexible belt 30 to the fabric covering 12 forming part of the bottom wall 20 and the end walls 22, 24.

For the sake of completeness, there is shown edge welting or flexible beading denoted generally by the reference numeral 36 which is attached by means of stitching labeled 38. In order to open the front wall 26 to gain access to the interior of the luggage 10, there is a conventional zipper 40 that extends vertically along the forward edge of the bottom wall 20 and the forward edges of the end walls 22 and 24. The zipper 40 includes interfitting strip halves 40*a*, 40*b*, and in the illustrated instance two pulls 40*c*, 40*d*, both being shown somewhat arbitrarily in a central position at the bottom in FIG. 1 which have pulled the two halves 40*a*, 40*b* together to thus close the suitcase.

Figure 3:
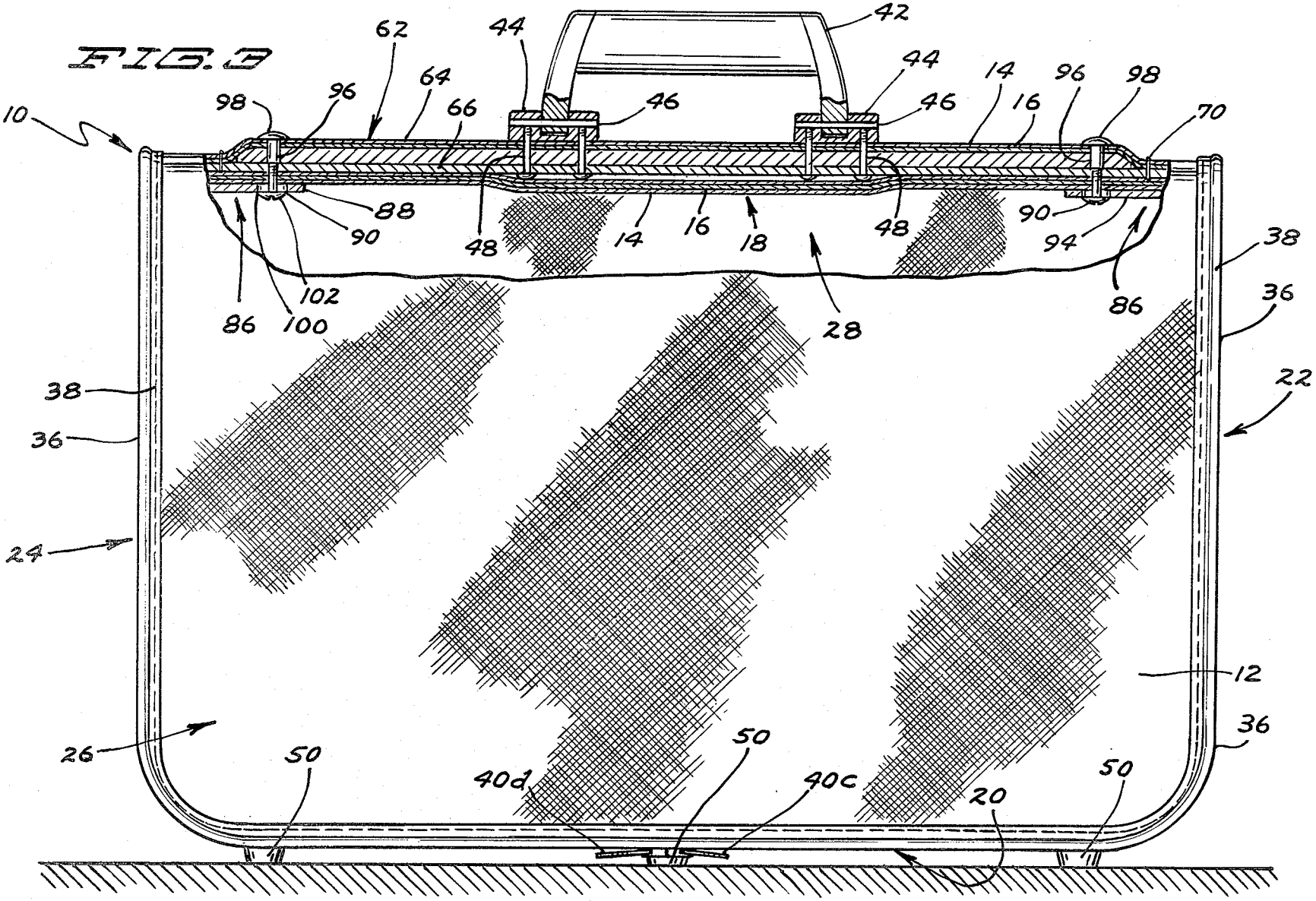
FIG. 3 is a longitudinal sectional view taken in a vertical plane through the center of the luggage of FIG. 1, as denoted by the line 3—3.

A U-shaped rigid handle 42 permits the luggage 10 to be conveniently carried. The handle 42 is pivotally attached to a pair of clevis-like brackets 44 through the agency of a pair of pins 46, there being one such pin press fitted into each bracket 44 and extending freely through the end of the handle 42 with which it is associated (see FIG. 3). A pair of screws 48 extend upwardly into tapped recesses in the bottom faces of each bracket 44.

Figure 2:
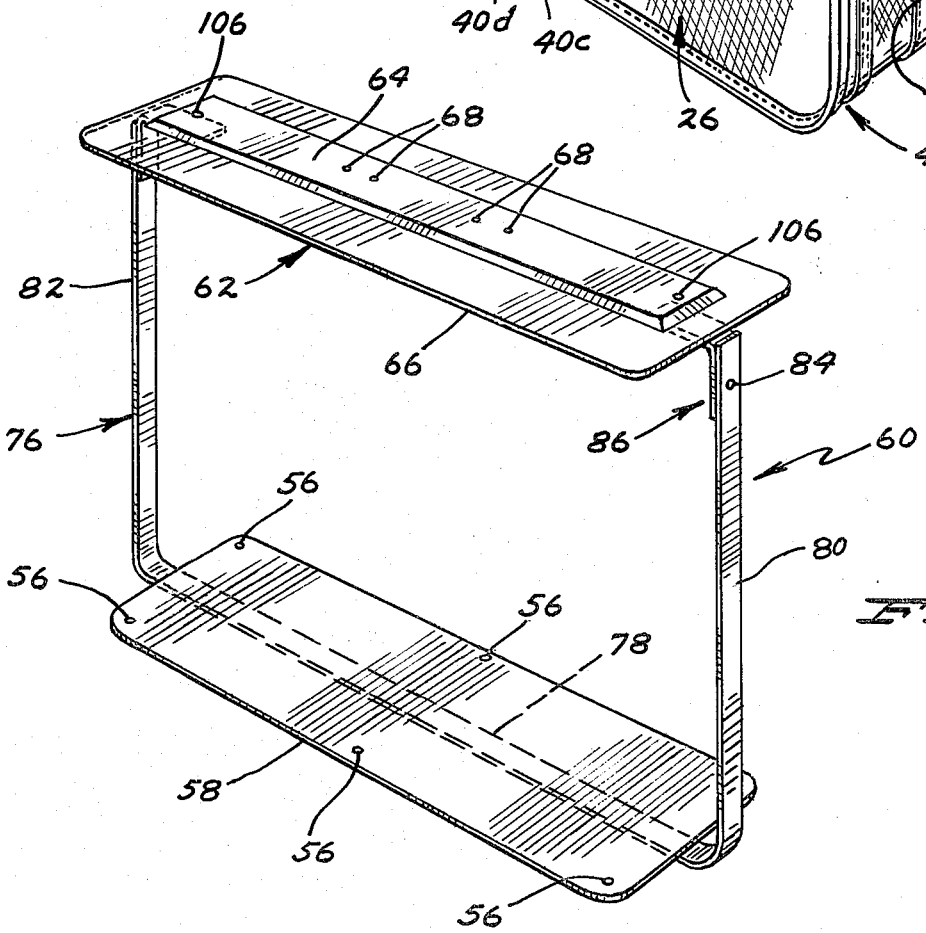
FIG. 2 is a perspective view of the frame contained within my luggage, the view being taken in the same direction as FIG. 1.

Disposed beneath the bottom wall 20 are six circular feet 50 which are held in place by means of rivets 52, the rivets 52 in each instance extending downwardly through a hole 56 in an aluminum bottom plate 58 (FIG. 2). The plate 58 is relatively thin (approximately 1/16 inch thick). The plate 58, it will be appreciated, is incorporated into the bottom wall 20.

Playing an important role in my invention is a frame that has been indicated generally by the reference numeral 60. The frame 60 includes a relatively rigid saddle 62 composed of a five-ply plywood strip 64 (approximately 3/16 inch thick) and a fiberboard panel 66 (approximately 1/16 inch thick) secured thereto by means of a suitable adhesive or a number of randomly located staples (not shown). It should be noted that the strip 64 is inset from the side edges of the panel 66. Two pairs of appropriately spaced holes 68 (FIG. 2) extend through the saddle 62 (both the strip 64 and the panel 66) for the accommodation of the earlier-mentioned screw posts 96. It should also be observed that the panel 66 extends for all intents and purposes to the upper edges of the end walls 22, 24. Further, a row of stitching 70 extends completely around the strip 64, the stitching passing through the fiberboard 66 and the fabric layer 12 (see FIG. 6) and thereby, in a sense, forming a closed pocket for the accommodation therein of the strip 64. Additional stitching 72, actually a double row, extends along the outer edges of the fiberboard panel 66, the stitching 72 passing through the fabric layers 12, 16 and through the panel 66. Thus, it should be appreciated that the thickness and material for the panel 66 is selected so as to permit the stitching 70, 72 to be effected.

It will also be observed at this time that the frame 60 includes a spring band 76, preferably of carbon steel. Actually, the steel that has been used in actual practice and found satisfactory has the designation SAE 1075 which steel possesses the proper degree of hardness and resiliency for use in my luggage 10. This steel is generically referred to as blue tempered, scaleless carbon steel.

It is of importance to dimension the band or strip 76 in order to provide the right degree of resiliency. In this regard, it has been found that the strip should preferably be $\frac{3}{4}$ inch wide with a thickness of 0.025 inch. The strip or band 76 includes a horizontal bottom portion 78 that underlies the plate 58 but is not secured thereto. Consequently, while the horizontal portion or section 78 bears against the underside of the aluminum plate 58, this portion 78 of the band 76 is free to flex relative thereto. The band portion 78 is restrained from shifting laterally by reason of the heavy fabric strip or belt 30, and the flanking two rows of stitching 32, 34. Stated somewhat differently, the belt 30, together with the stitching 32, 34 and the central portion of the plate 58, acts as a sheath for the horizontal portion or section 78. Integral with the ends of the bottom portion 78 are upstanding leg sections 80 and 82, each leg section having a hole 84 near its upper end. Hence, as can be readily discerned from FIG. 2, the spring strip or band 76 possesses a U-shaped appearance composed of the portions or sections 78, 80 and 82.

Also of importance to the invention is the employment of two angle irons 86, each having a horizontal leg 88 formed with a slot 90, and a vertical leg 92 having a slot 94 therein. The horizontal leg 88 is adjustably secured to the underside of the top wall 18 by means of a screw post 96 having a round head 98 integral therewith, and an upwardly directed screw 100 having a round head 102 integral therewith, the head 102 being formed with a slot 104 for the accommodation of a screwdriver tip therein. It will be apparent that one screw 100 extends upwardly through the slot 90 formed in the horizontal leg 88 of the angle 86, doing so through a hole 106 in the saddle 62 at one end of the luggage 10, and the other screw 100 similarly extends upwardly through a second hole 106 in the saddle 62 at the other end of the luggage 10.

It should be evident that the slot 90 enables the angle iron 86, in each instance, to be moved horizontally so as to abut the vertical leg 92 thereof into a confronting engagement with the upper end portion of the upwardly directed leg sections 80, 82 integral with the resilient band or strip 76. Thus, it should be readily appreciated that an additional screw post 108 having a round head 110 extends inwardly through each of the holes 84 in the legs 80, 82 and also in each instance through the slot 94 in the vertical leg 92 of each of the angle irons 86. A screw 112 having a round head 114 is threadedly received in the screw post 108, the head 114 having a screwdriver slot 116 therein. It should be apparent that the slot 94 permits an upward positioning of the angle iron 86 in each instance so that the horizontal leg 88 thereof can be placed against the underside of the top wall 18.

Figure 4:
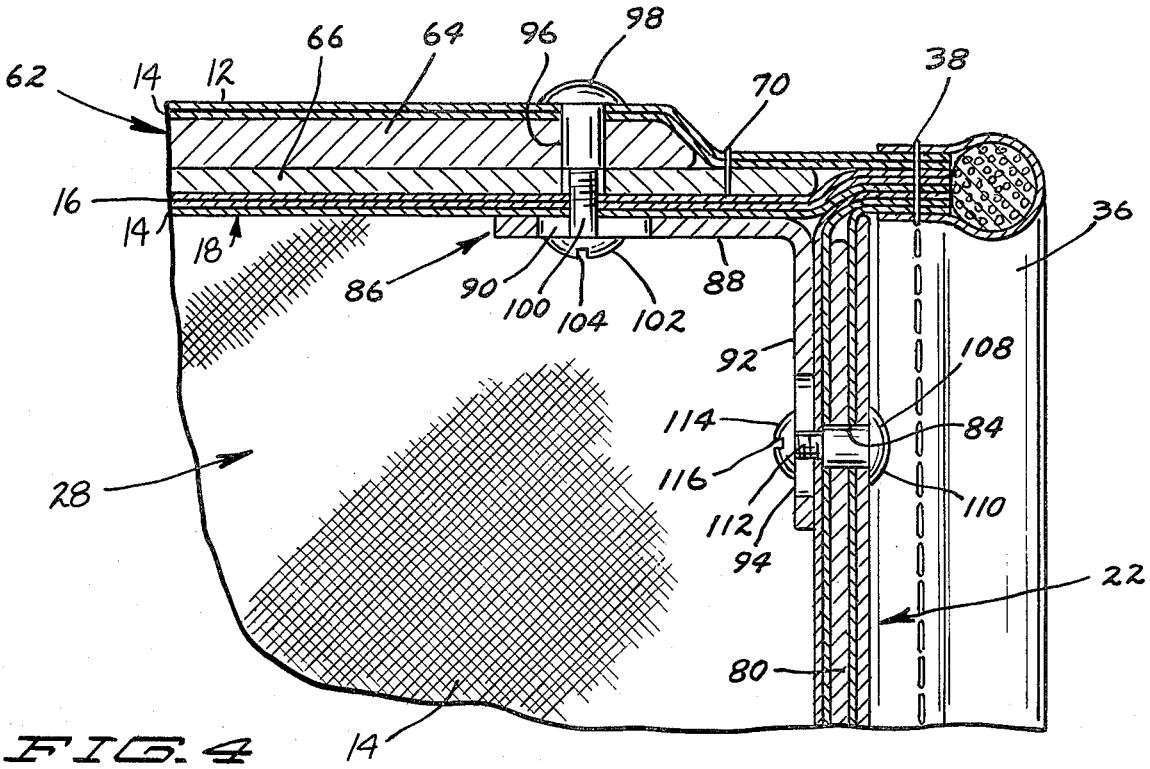
FIG. 4 is an enlarged fragmentary view of the upper right hand corner appearing in FIG. 3.
Figure 5:
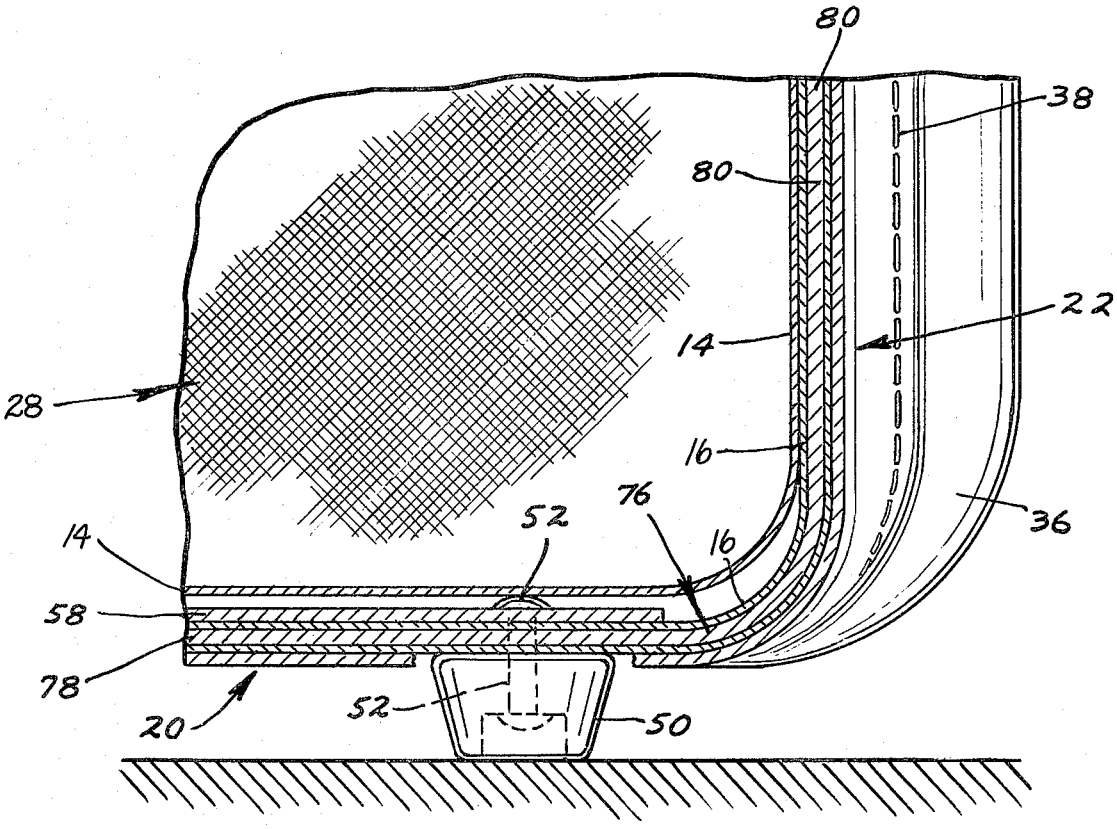
FIG. 5 is an enlarged fragmentary view of the lower right hand corner of FIG. 3.
Figure 5:
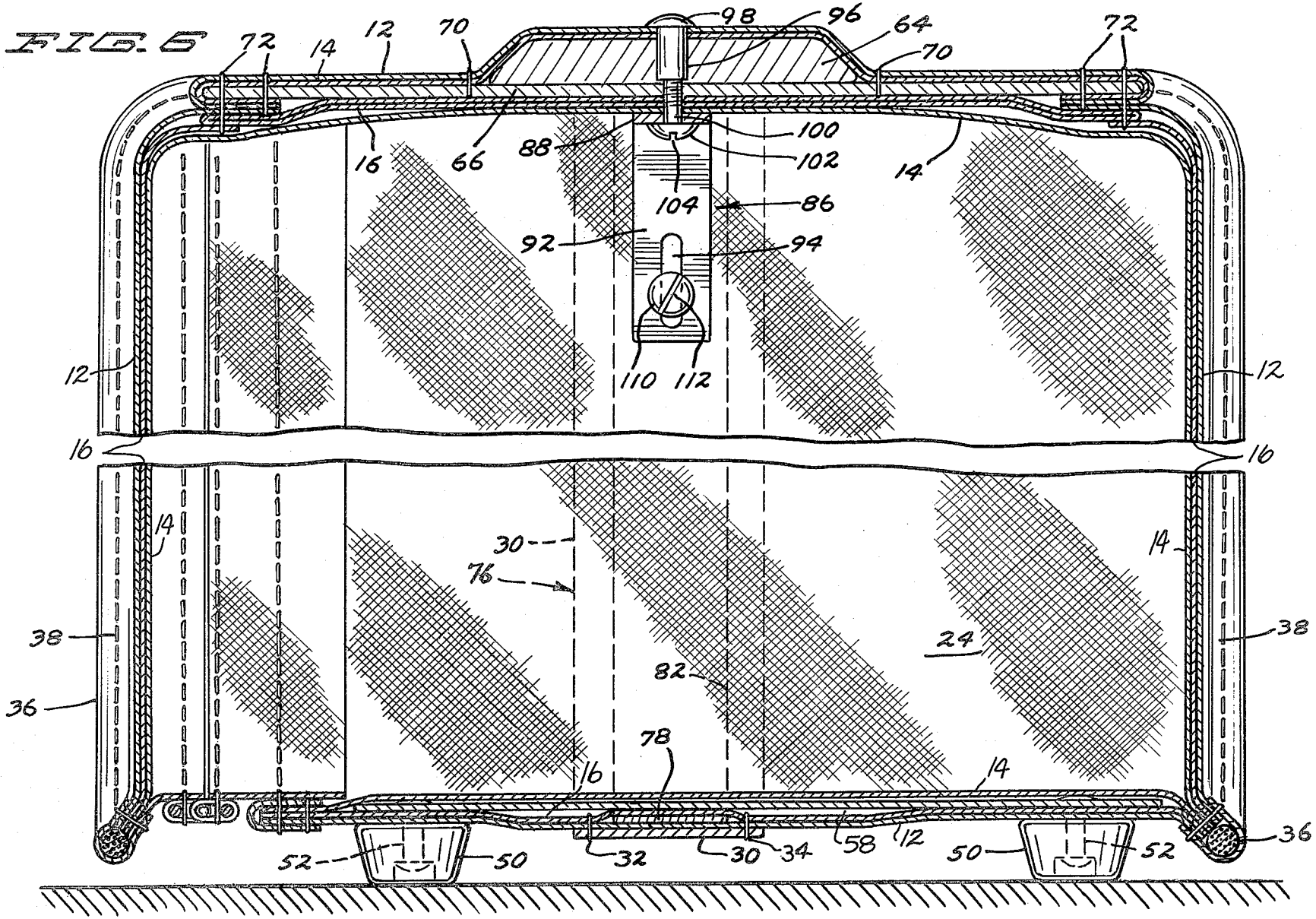
Figure 7:
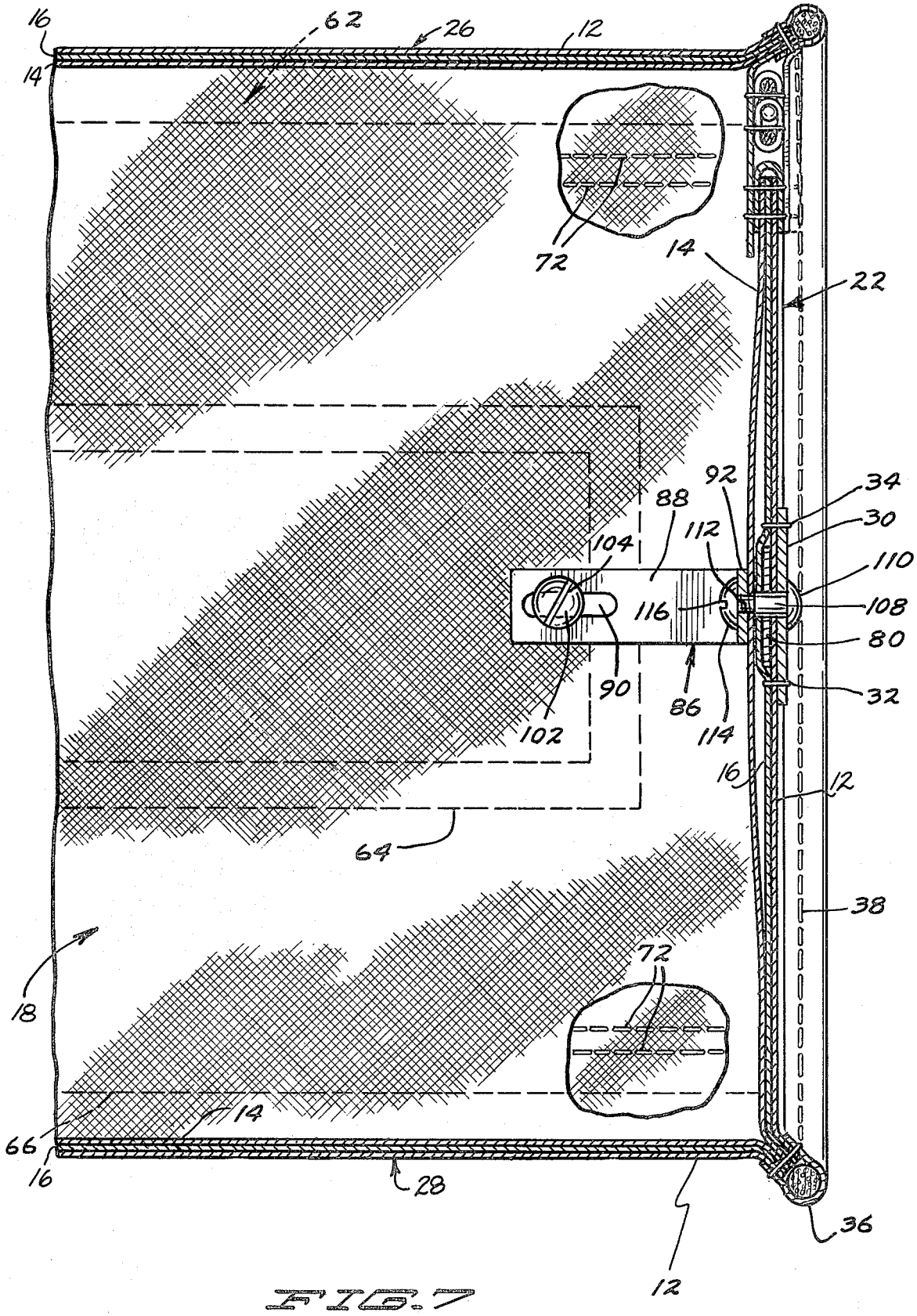
FIG. 7 is a fragmentary horizontal sectional view looking upwardly, the view being taken in the direction of line 7—7 of FIG. 1.

The sequence in which the parts comprising the luggage 10 are assembled is not particularly important. It is important, however, to prevent the upper ends of the band leg sections 80, 82 from projecting above the plane of the panel 66. Even though all stitching is complete, the saddle 62 can be raised or lowered sufficiently so as to cause the upper ends of the panel 66 to be in a plane slightly above the upper ends of the leg sections 80 and 82. It is then that the screws 112 can be tightened with a screwdriver. From FIG. 4, it will be recognized that the thicknesses of the fabric layers 14 and 16 can be readily accommodated. By the same token, the upper ends of the leg sections 80, 82 can be readily flexed into an optimum relation with the ends of the panel 66, tightening of the screws 100 maintaining the adjustment, as can also be understood from FIG. 4. The point to be appreciated is that the need for close tolerances of these upper end locations is obviated.

It has already been explained that the resilient band or strip 76 is held in a sheath-like relation by means of the belt 30. This is particularly important as far as the bottom portion or section 78 is concerned. Since the six rivets, which hold the feet in place, extend through the fabric 12 constituting the outer covering, and the aluminum plate 58 and the fabric 12 is secured to the belt 30, the plate 58 cannot shift relative to the belt 30. In this way, the bottom portion 78 of the band 76 remains centrally disposed beneath the plate 58, functioning much like a sling.

Still further, it is to be borne in mind that the saddle 62, being quite rigid by virtue of the plywood strip 64, does not bow upwardly when the luggage 10 is lifted by means of its handle 42. The lifting force is transmitted through the saddle 62 to the vertical leg portions or sections 80, 82 of the band 76 via the two angle irons 86. Additionally, cognizance should be taken of the fact that the leg portions or sections 80, 82 during lifting of the luggage 10 are in tension, because the weight of the items contained in the luggage 10 exert a downward force on the plate 58. Yet, the leg portions or section 80, 82, being highly resilient by reason of their thickness (only 0.025 inch), can be readily flexed inwardly when subjected to horizontal impact forces (the plate 58 and the portion 78 underlying or cradling same bowing or flexing downwardly), and readily flexed outwardly when crushing forces are applied from above (through any segment of the saddle 62) or from below (through any segment of the horizontal spring portion or section 78 of the band 76 or the plate 58). Still additionally, owing to the relatively narrow width ($\frac{3}{4}$ inch) of the resilient band 76, the band 76, especially either vertical leg section 80 or 82, can twist, thereby effectively withstanding torsional forces, as well.

Consequently, by reason of the frame 60 my luggage 10 possesses the capability of deforming readily, virtually to whatever degree is necessary for the particular forces being applied, yet being capable of springing back to its original shape when the distorting force (or forces) is no longer experienced.

Inasmuch as it is important that luggage of the type herein described by very light in weight, it can be pointed out that a suitcase on the order of $22\times17\times7$ inches, when constructed in accordance with the teachings of my invention, weighs slightly less than $3\frac{1}{2}$ pounds.

I claim:

1. Luggage comprising a pliable cover material forming flexible top, bottom, end, front and rear walls, a plate overlying said bottom wall and generally coextensive therewith, a metallic spring band having a section underlying only the central portion of said plate and spaced inwardly from said front and rear walls, said spring band including upwardly extending integral leg sections confronting only central portions of said end walls and spaced inwardly from said front and rear walls, a panel underlying said top wall and generally coextensive therewith, and respective means fixedly connecting and fastening centrally disposed end portions of said panel to the upper ends of said leg sections.

2. Luggage in accordance with claim 1 including a strip overlying said upper panel, said strip being wider than said spring band but having its side edges inset from the side edges of said panel.

3. Luggage in accordance with claim 2 in which said plate and panel are relatively thin and said strip is relatively thick.

4. Luggage in accordance with claim 3 including means securing said strip to said panel.

5. Luggage in accordance with claim 3 in which said strip is of plywood and said panel is of fiberboard.

6. Luggage in accordance with claim 5 in which said bottom plate is of aluminum.

7. Luggage in accordance with claim 1 in which said respective connecting means includes a pair of angle irons, each having a horizontal leg secured to the underside of said panel and each having a vertical leg secured to the upper end of each leg section of said spring band.

8. Luggage in accordance with claim 7 in which the legs of said angle irons each have a slot therein, first respective means extending through said panel and the slots in the horizontal legs of said angle irons to secure said angle irons to said panel, and second respective means extending through the upper ends of the leg sections of said spring band to secure said angle irons to the leg sections of said spring band.

9. Luggage in accordance with claim 8 in which said first respective means includes a pair of screw posts and a pair of screw elements received therein, and said second respective means includes a pair of screw posts and a pair of screw elements received therein.

10. Luggage in accordance with claim 1 including fabric belt stitched to the fabric covering constituting the end walls, said belt extending beneath said bottom wall and stitched thereto so as to enclose said spring band.

11. Luggage in accordance with claim 10 in which the width of said band is on the order of $\frac{3}{4}$ inch and the thickness of said band is on the order of 0.025 inch.

12. Luggage in accordance with claim 11 in which said spring band is of carbon steel.

13. Luggage in accordance with claim 1 including a relatively rigid strip secured to the upper side of said panel to form a saddle, said strip being wider than said band, a handle, and means attaching said handle to said saddle.

14. Luggage in accordance with claim 13 in which said rigid strip extends to locations near the opposite ends of said panel.

15. Luggage comprising a frame, said frame including a rigid rectangular saddle, a resilient U-shaped metal band, and respective fastening means mechanically connecting the centrally disposed end portions of said saddle directly to the upper ends of said band.

16. Luggage in accordance with claim 15 including a plate loosely overlying the bottom of said resilient band so that said plate is supported by the bottom of said band without securement thereto.

17. Luggage in accordance with claim 16 in which said means for attaching said saddle to said band includes in each instance an angle iron having a horizontal leg and a vertical leg, each of said legs having a slot therein, screw means extending downwardly through the ends of said saddle and through the slots in the horizontal legs of the angle irons, and additional screw means extending inwardly through the upper ends of said band and through the slots in the vertical legs of said angle irons.

18. Luggage in accordance with claim 17 including a pair of brackets, and screw means extending upwardly through said saddle and threadedly received in said brackets, and a handle hingedly connected to said brackets.

19. Luggage in accordance with claim 18 in which said saddle includes a relatively narrow strip of plywood, a wider panel of fiberboard, and fabric stitched to said fiberboard adjacent the side edges of said strip and said fabric also being stitched to said fiberboard panel adjacent the side edges thereof.

20. Luggage in accordance with claim 16 including a flexible fabric belt underlying the section of said band beneath said plate, said band being free to bow relative to said plate and belt.

21. Luggage in accordance with claim 20 in which the edges of said belt are stitched to said fabric along the edges of said band.

22. Luggage in accordance with claim 21 including a plurality of feet, and means extending through said plate and the fabric therebeneath holding said feet in place.

* * * * *

UNITED STATES PATENT AND TRADEMARK OFFICE

CERTIFICATE OF CORRECTION

PATENT NO. : 4,433,760
DATED : February 28, 1984
INVENTOR(S) : Joseph Y. Pelavin It is certified that error appears in the above-identified patent and that said Letters Patent are hereby corrected as shown below:

Col. 1, line 64; "portins" should be --- portions ---.

Col. 2, line 8; "has still" should be --- has as still ---;
line 68; "suitace" should be --- suitcase ---.

Col. 5, line 31; "section" should be --- sections ---.

Signed and Sealed this

*Sixth* Day of *November 1984*

[SEAL]

*Attest:*

GERALD J. MOSSINGHOFF

*Attesting Officer*

*Commissioner of Patents and Trademarks*